US005911169A

United States Patent [19]

Lichtenstein

[11] Patent Number: 5,911,169

[45] **Date of Patent: *Jun. 8, 1999**

[54] RECORDING SENSOR MOUNTING RAIL FOR KEYBOARD OPERATED MUSICAL INSTRUMENT

[75] Inventor: Donald Lichtenstein, Orangevale, Calif.

[73] Assignee: Burgett, Inc., Sacramento, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/730,419

[22] Filed: Oct. 15, 1996

[51] Int. Cl.[6] ..... G10G 3/00

[52] U.S. Cl. ..... 84/461; 84/462

[58] Field of Search ..... 84/461, 462

[56] References Cited

U.S. PATENT DOCUMENTS

| | | | |
|---|---|---|---|
| 4,974,482 | 12/1990 | Tamaki et al. . | |
| 5,010,799 | 4/1991 | Tanaka et al. . | |
| 5,081,892 | 1/1992 | Broadmoore | 84/19 |
| 5,237,125 | 8/1993 | Fields . | |
| 5,546,842 | 8/1996 | Pimentel . | |

*Primary Examiner*—William M. Shoop, Jr.
*Assistant Examiner*—Kim Lockett
*Attorney, Agent, or Firm*—John P. O'Banion

[57] ABSTRACT

An extruded recording sensor mounting rail for keyboard operated musical instruments, particularly electronic player pianos, which can be used to install recording sensors in a new or existing piano. First and second flanges extend longitudinally along the front and rear of the mounting rail, and a shelf is provided on each flange, with the shelves configured for receiving and supporting a circuit board in a sensor assembly. Each flange includes an outward facing lip which extends longitudinally along the flange. One or more clips each include flanges which fit over the outward facing lips and retain the sensor board on the mounting rail.

19 Claims, 3 Drawing Sheets

RECORDING SENSOR MOUNTING RAIL FOR KEYBOARD OPERATED MUSICAL INSTRUMENT

BACKGROUND OF THE INVENTION

1. Field of the Invention

This invention pertains generally to recording keystroke information in a keyboard operated musical instrument, and more particularly to a mounting rail assembly for supporting optical recording sensors associated with the keys, hammers, hammer shanks or hammer catchers in a piano.

2. Description of the Background Art

Recording sensors are commonly used in electronic player piano systems to capture keystroke information. Typically, sensor assemblies are mounted below the keyboard to sense the movement and position of the keys for recording the original piano performance. In conventional player piano systems, the sensor assemblies are mounted on a common rack assembly which is sized to match the size of the keyboard. Since the rack assembly must be sized to match the size of the keyboard, it is necessary to customize the rack assembly for different types of player pianos.

Currently available rack assemblies do not provide for adjustability of the position of the sensors in relation to the keys. In the piano industry, however, there are at least four distinct piano key spacing arrangements. It will be appreciated that there is a large number of individual keys to be sensed in a player piano. Further, optical sensors may be positioned for sensing the movement and position of hammers, hammer shanks, or other moving portions of the piano which are associated with the piano keys. Currently used sensor rack assemblies are generally structured and configured to be positioned beneath the piano keys themselves, and are not suitable for supporting optical sensors which detect position and motion of hammers, hammer shanks, or moving parts other than the piano keys themselves.

Thus, there is a need for an apparatus which will allow for sensing key movement without interfering with the key movement, which provides for accurate positioning of each sensor in relation to the corresponding key, and which can be used for supporting optical sensors for the detection of position and movement of hammers, hammer shanks, or like moving parts of a piano which are associated with the keys. There is a further need for sensor assemblies which can be easily retrofitted to existing pianos with varying keyboard sizes and key spacing configurations. The present invention satisfies those needs, as well as others, and overcomes the deficiencies found in conventional sensor assembly mounting techniques.

SUMMARY OF THE INVENTION

The present invention pertains to a recording sensor mounting rail assembly for keyboard operated musical instruments, particularly electronic player pianos, which can be used to install recording sensors in a new or existing piano and provide for accurate alignment of the sensors in association with the individual keys in the instrument.

By way of example, and not of limitation, the invention comprises an elongated mounting rail which is preferably extruded as an integral component. A pair of flanges extend along the front and back edges of the mounting rail, and an open channel is defined between the flanges. Each flange includes a step or shelf that extends along the flange, with a shoulder running along the inner edge of the shelf, and a corner running along the outer edge of the shelf. An outward facing lip extends along a top of each flange, with the outward facing lips preferably having an arcuate or curved cross-sectional shape. The shelves on the flanges are structured and configured to receive a sensor assembly. One or more clip members are provided with the invention which fit over the outward facing lips on the flanges to retain the sensor assembly in place on the shelves. Each clip member has a pair of curved prongs which are structured and configured to snap fit over the outward facing lips. Preferably, the clip members each include a downward facing boss or projection which is received by a corresponding opening in the sensor assembly, to further aid in retaining the sensor assembly in place. A second outward facing lip preferably extends along each flange below and parallel to the first outward facing lip, and a groove or slot is defined therebetween. The ends of the curved flanges on the clip members are received by the groove between the outward facing lips. A plurality of the rails may be joined together end to end in order to provide a sensor assembly which extends along the length of the keyboard of the piano.

An object of the invention is to provide a recording sensor mounting rail which permits accurate alignment of the recording sensors in relation to the keys, hammers, hammer shanks, or like moving part associated with the keys in a keyboard operated musical instrument.

Another object of the invention is to provide a recording sensor mounting rail which allows multiple rails to be connected to accommodate different sizes of keyboards.

Another object of the invention is to provide a recording sensor mounting rail which can be easily retrofitted to existing keyboards.

Another object of the invention is to provide a recording sensor mounting rail which provides for stable mounting of recording sensor assemblies.

Further objects and advantages of the invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
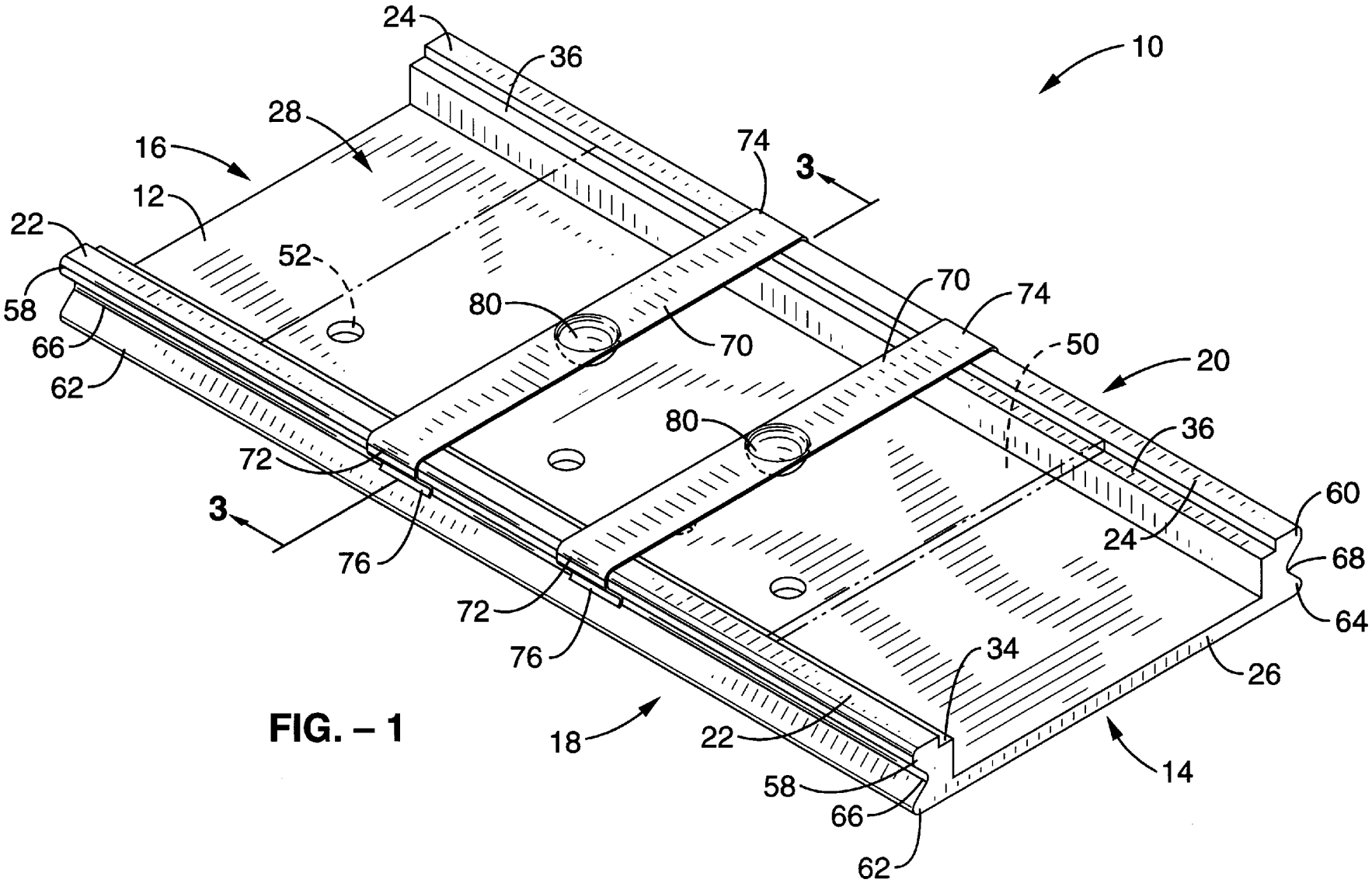
FIG. 1 is a perspective view of a mounting rail assembly in accordance with the present invention with a recording sensor assembly shown in phantom.
Figure 2:
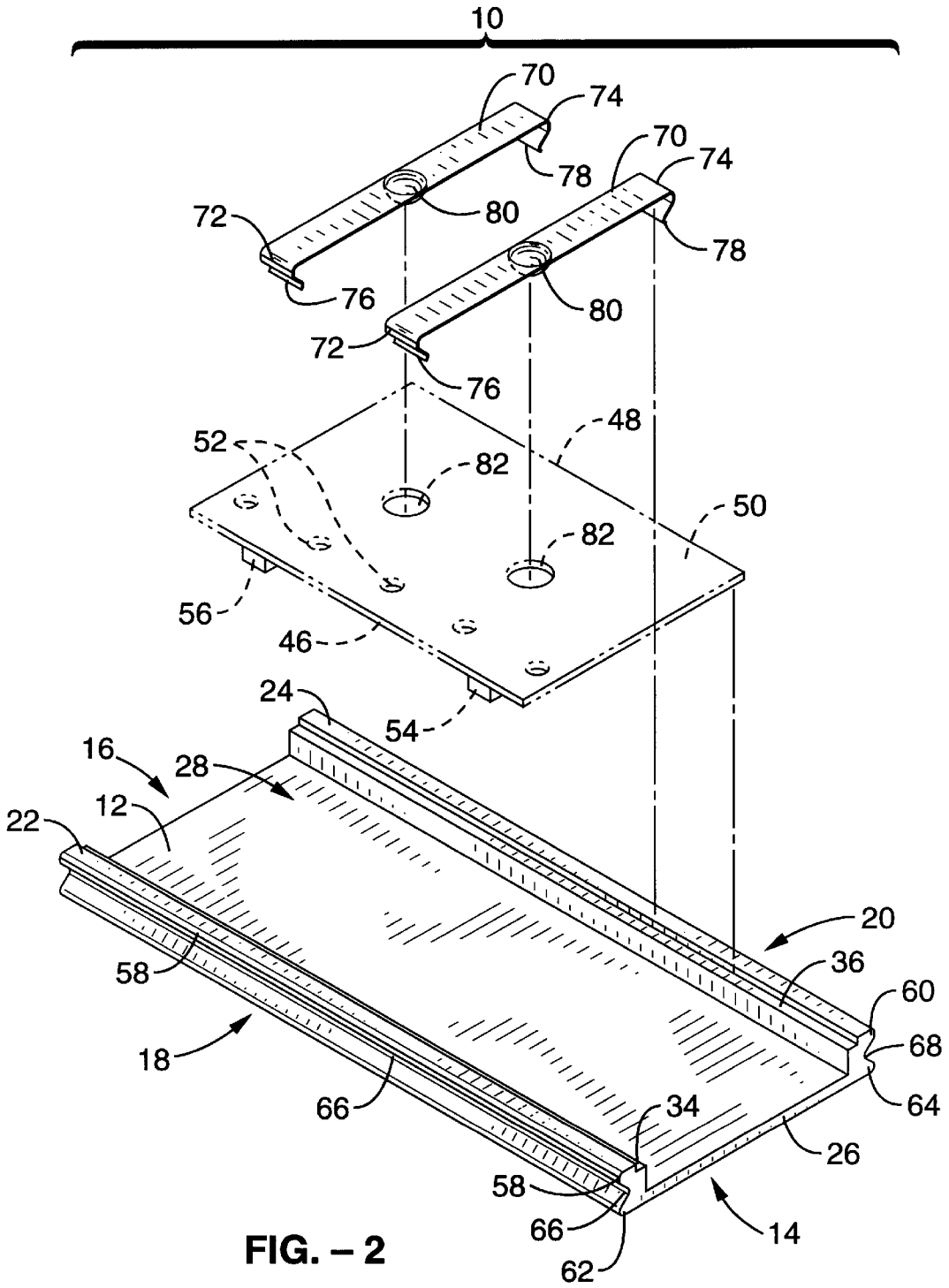
FIG. 2 is an exploded view of the assembly shown in FIG. 1.
Figure 3:
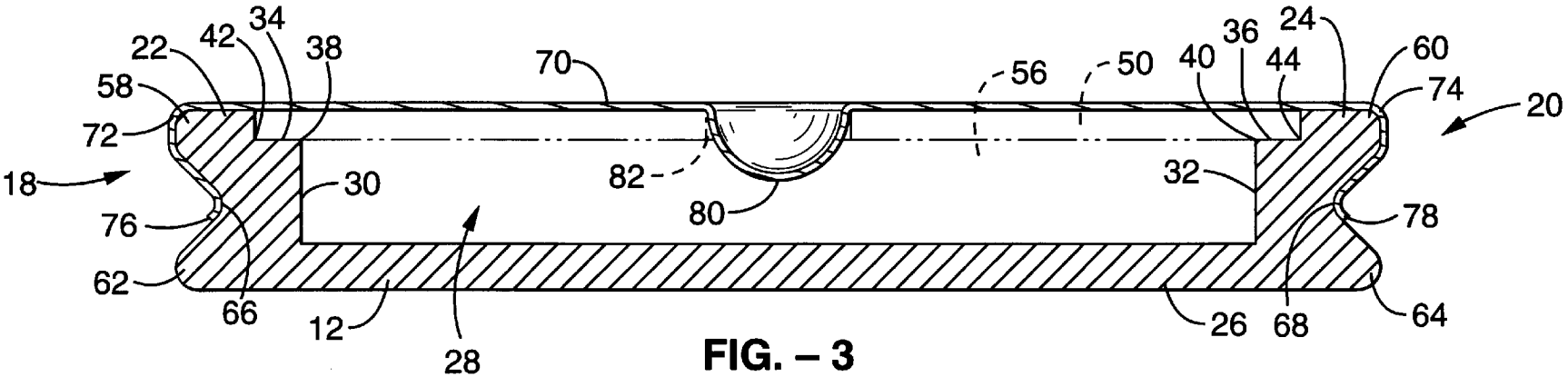
FIG. 3 is a cross-sectional view of the mounting rail and recording sensor assembly shown in FIG. 1 taken through line 3—3 with the recording sensor assembly shown in phantom.

Referring more specifically to the drawings, for illustrative purposes the present invention is embodied in the apparatus shown generally in FIG. 1 through FIG. 3, wherein like reference numerals denote like parts. It will be appreciated that the invention may vary as to configuration and as to details of the parts without departing from the basic concepts as disclosed herein.

Referring to FIG. 1 through FIG. 3, a recording sensor mounting rail assembly 10 in accordance with the present invention is generally shown. The invention includes a mounting rail 12 which is preferably extruded from a lightweight material such as aluminum, engineering resin or the like as an elongated member having first and second ends 14, 16, and front and rear sides 18, 20. First and second elongated flanges 22, 24 are included on mounting rail 12, and extend longitudinally between first and second ends 14, 16 of mounting rail 12. Flanges 22, 24 project generally upward from a base portion 26 of mounting rail 12, and an elongated channel 28 is defined between inner walls 30, 32 of flanges 22, 24 and adjacent base portion 26.

First and second elongated shelves 34, 36 are included on first and second flanges 22, 24 respectively of mounting rail 12. Shelves 34, 36 extend longitudinally between first and second ends 14, 16 of mounting rail 12. Referring more particularly to FIG. 3, first and second shoulders 38, 40 are included along the inner edges of shelves 34, 36 respectively adjacent inner walls or faces 30, 32 of flanges 22, 24 respectively. Shoulders 38, 40 extend longitudinally along the length of mounting rail 12 between first and second ends 14, 16. First and second corners 42, 44 are included on first and second flanges 22, 24 adjacent first and second shelves 34, 36 respectively on the outward sides thereof.

Referring more particularly to FIG. 2, shelves 34, 36 are structured and configured to receive and support the edges 46, 48 of a circuit board 50 whereon are mounted a plurality of sensors 52. Sensors 52 may comprise optical photoemitter/detectors such as Kodenshi SG 107 devices, or other types of optical or piezoelectric sensors. Edges 46, 48 of circuit board 50 fit adjacent corners 42, 44, and rest on shelves 34, 36 respectively. Support braces 54, 56 on circuit board 50 are accommodated by channel 28. The position or spacing of sensors 52 on circuit board 50 may be varied as required to accommodate the configuration of piano keys, hammers, hammer shanks or the like which are to be sensed by sensors 52.

First and second upper, outward facing lips or runners 58, 60 are included on flanges 22, 24 respectively of mounting rail 12. Outward facing lips 58, 60 are adjacent shelves 34, 36 respectively, and extend longitudinally between first and second ends 14, 16 of mounting rail 12. Outward facing lips 58, 60 preferably have a curvilinear or arcuate cross-sectional shape. Preferably, mounting rail 12 also includes first and second lower, outward facing lips 62, 64 located on first and second flanges 22, 24 respectively. Lower outward facing lips 62, 64 are adjacent and parallel to upper outward facing lips 58, 60 respectively, and extend between first and second ends 14, 16 of mounting rail. Outward facing lips 62, 64 preferably have a curvilinear or arcuate cross-sectional shape. An elongated groove 66 is defined between upper and lower lips 58, 62, and an elongated groove 68 is defined between upper and lower lips 60, 64, with grooves 66, 68 generally extending along the length of mounting rail 12 between first and second ends 14, 16.

One or more clip members 70 are used in conjunction with mounting rail 12 to secure circuit board 50 onto mounting rail 12. Clip members 70 include first and second prongs 72, 74. Prongs 72, 74 are preferably made of resilient material and are curved in structure and in an opposing relationship as shown. Prongs 72, 74 are structured and configured to snap fit or slide over outward facing lips 58, 60 in order to retain circuit board 50 on mounting rail 12. Prongs 72, 74 include ends 76, 78 respectively, with ends 76, 78 being structured and configured to fit into grooves 66, 68 when clip members 70 are attached to mounting rail 12 with prongs 72, 74 fitting over outward facing lips 58, 60. Preferably, clip members 70 each include a protrusion or stud 80 which is accommodated by a matching bore 82 in circuit board. Studs 80 engage bores 82 when clip members are attached to mounting rail 12, and prevent longitudinal sliding of circuit board 50 relative to mounting rail 12.

Circuit board 50 is attached to mounting rail 12 by placing edges 46, 48 of circuit board 50 onto shelves 34, 36 on flanges 22, 24 of mounting rail 12, with edges 46, 48 of circuit board generally flush with corners 42, 44, with the top of circuit board 50 being generally flush with the tops of flanges 22, 24, and with support braces 54, 56 located within channel 28 of mounting rail 12. Clip members 70 are positioned over mounting rail and circuit board 50, and the prongs 72, 74 of clip members 70 are snap fitted over outer lips 58, 60 of flanges 22, 24, and studs 80 on clips 70 are inserted into openings 82 in circuit board. Clips 70 hold circuit board 50 onto shelves 34, 36 and studs 80 prevent longitudinal slipping of circuit board 50 along shelves 34, 36.

The assembled mounting rail 12 with attached circuit board 50 and clips 70 is used by suitably positioning the assembly 10 adjacent to a keyboard assembly (not shown) such that each optical sensor 52 is positioned to sense a moving portion of the keyboard assembly. As described above, optical sensors 52 may be used to monitor the movement of piano keys, hammers, hammer shanks, or hammer catchers actuated by the piano keys. Since there generally are eighty eight keys on a standard piano keyboard, a plurality of mounting rail assemblies 10 are preferably used in conjunction with each other, and are joined together end to end, with the first end 14 of one mounting rail 12 being adjacent to the second end 16 of a like mounting rail.

Accordingly, it will be seen that the recording sensor mounting rail of the present invention provides for convenient mounting of recording sensor assemblies in association with the keyboard assembly of a keyboard operated musical instrument in a manner which can accommodate different keyboard lengths and varied key spacing. Although the description above includes many specificities, these should not be construed as limiting the scope of the invention but as merely providing illustrations of some of the presently preferred embodiments. Thus, the scope of this invention should be determined by the appended claims and their legal equivalents.

What is claimed is:

1. An apparatus for supporting a recording sensor assembly in a keyboard operated musical instrument, comprising:

(a) an elongated mounting rail, said mounting rail having first and second ends;

(b) said mounting rail including first and second spaced apart elongated flanges extending longitudinally between said first and second ends of said mounting rail, said first and second flanges defining an elongated channel therebetween;

(c) each said flange including an elongated inner shelf and a first outward facing lip;

(d) at least one clip member, said clip member including a pair of prongs, said prongs structured and configured to fit over said outward facing lips; and (e) a protrusion located between said pair of prongs said protrusion structured and configured to engage a hole or bore on a circuit board.

2. An apparatus as recited in claim 1, wherein each said flange includes a shoulder.

3. An apparatus as recited in claim 1, wherein said inner shelves are structured and configured to support a recording sensor assembly.

4. An apparatus as recited in claim 1, wherein each said flange includes a second outward facing lip parallel to said first outward facing lip, said first and second outward facing lips spaced-apart and defining a groove therebetween.

5. An apparatus as recited in claim 4, wherein said prongs on said clip member each include an end, said ends of said prongs fitting into said grooves defined between said first and third outward facing lips and said second and fourth outward facing lips.

6. An apparatus as recited in claim 1, wherein said protrusion comprises a stud.

7. An apparatus for supporting a recording sensor assembly in a keyboard operated musical instrument, comprising:

(a) an elongated mounting rail, said mounting rail having first and second ends, said mounting rail having front and rear sides;

(b) said mounting rail including first and second elongated flanges, said first and second flanges extending longitudinally between said first and second ends of said mounting rail, said first flange adjacent said front side, said second flange adjacent said rear side, said first and second flanges defining an elongated channel therebetween;

(c) said mounting rail including first and second elongated shelves, said first shelf included on said first flange, said second shelf included on said second flange;

(d) said mounting rail including first and second shoulders, said first and second shoulders included on said first and second flanges respectively, said first and second shoulders adjacent an inside edge of said first and second shelves respectively;

(e) said mounting rail including first and second corners, said first and second corners included on said first and second flanges respectively, said first and second corners adjacent an outer edge of said first and second shelves respectively;

(f) said mounting rail including first and second outward facing lips, said first outward facing lip included on said first flange adjacent said first shelf, said second outward facing lip included on said second flange adjacent said second shelf;

(g) at least one clip member, said clip member including a pair of opposing prongs, said prongs structured and configured to fit over said first and second outward facing lips; and (h) a protrusion located between said pair of prongs, said protrusion structured and configured to engage a hole or bore on a circuit board.

8. An apparatus as recited in claim 7, wherein said first and second shelves are structured and configured to support first and second edges respectively of a recording sensor assembly.

9. An apparatus as recited in claim 7, further comprising (a) a third outward facing lip, said third outward facing lip included on said first flange, said third outward facing lip parallel to said first outward facing lip, said first and third outward facing lips defining a groove therebetween; and (b) a fourth outward facing lip, said fourth outward facing lip included on said second flange, said fourth outward facing lip parallel to said second outward facing lip, said second and fourth outward facing lips defining a groove therebetween.

10. An apparatus as recited in claim 9, wherein said prongs on said clip member each include an end, said ends of said prongs fitting into said grooves defined between said first and third outward facing lips and said second and fourth outward facing lips.

11. An apparatus as recited in claim 7, wherein said protrusion comprises a stud.

12. An apparatus as recited in claim 7, wherein said first and second outward facing lips each are arcuate in cross-section.

13. An apparatus as recited in claim 9, wherein said first, second, third and fourth outward facing lips are arcuate in cross-section.

14. An apparatus for supporting a recording sensor assembly in a keyboard operated musical instrument, comprising:

(a) an elongated mounting rail, said mounting rail having first and second ends, said mounting rail having front and rear sides;

(b) said mounting rail including first and second elongated, flanges, said first and second flanges extending longitudinally between said first and second ends of said mounting rail, said first flange adjacent said front side, said second flange adjacent said rear side, said first and second flanges defining an elongated channel therebetween;

(c) said mounting rail including first and second elongated shelves, said first shelf included on said first flange, said second shelf included on said second flange, said first and second shelves extending longitudinally between said first and second ends of said mounting rail;

(d) said mounting rail including first and second shoulders, said first and second shoulders included on said first and second flanges respectively, said first and second shoulders adjacent an inside edge of said first and second shelves respectively, said first and second shoulders extending longitudinally between said first and second ends of said mounting rail;

(e) said mounting rail including first and second corners, said first and second corners included on said first and second flanges respectively, said first and second corners adjacent an outer edge of said first and second shelves respectively; said first and second corners extending longitudinally between said first and second ends of said mounting rail;

(f) said mounting rail including first and second upper, outward facing lips, said first upper outward facing lip included on said first flange adjacent said first shelf, said second upper outward facing lip included on said second flange adjacent said second shelf, said first and second upper outward facing lips extending longitudinally between said first and second ends of said mounting rail;

(g) said mounting rail including first and second lower, outward facing lips, said first lower outward facing lip included on said first flange adjacent to and below said first upper outward facing lip, said second lower outward facing lip included on said second flange adjacent to and below said second upper outward facing lip, said first and second lower outward facing lips extending longitudinally between said first and second ends of said mounting rail;

(h) at least one clip member, said clip member including first and second opposing prongs, said first and second prongs structured and configured to fit over said first and second upper outward facing lips respectively; and (i) a protrusion located between said first and second prongs, said protrusion structured and configured to engage a hole or bore on a circuit board.

15. An apparatus as recited in claim 14, further comprising a first groove located between said first upper outward facing lip and said first lower outward facing lip, and a second groove located between said second upper outward facing lip and said second lower outward facing lip, said first and second grooves extending longitudinally between said first and second ends of said mounting rail.

16. An apparatus as recited in claim 15, wherein said first and second prongs on said clip member each include an end, said end of said first prong fitting into said first groove between said first upper outward facing lip and said first lower outward facing lip, said end of said second prong fitting between said second upper outward facing lip and said second lower outward facing lip.

17. An apparatus as recited in claim 14, wherein said protrusion comprises a stud.

18. An apparatus as recited in claim 14, wherein said first and second upper outward facing lips each are arcuate in cross-section.

19. An apparatus as recited in claim 18, wherein said first and second lower outward facing lips are arcuate in cross-section.

* * * * *